US008863998B2

(12) United States Patent
Painchaud et al.

(10) Patent No.: US 8,863,998 B2
(45) Date of Patent: Oct. 21, 2014

(54) LIQUID DISPENSING DEVICE

(75) Inventors: Gaetan Painchaud, Francheville (FR); Guillaume Grevin, L'Isle d'Abeau (FR); Thierry Decock, Paris (FR); Xavier Julia, Villefontaine (FR)

(73) Assignee: Rexam Healthcare la Verpilliere (FR)

( * ) Notice: Subject to any disclaimer, the term of this patent is extended or adjusted under 35 U.S.C. 154(b) by 0 days.

(21) Appl. No.: 13/418,159

(22) Filed: Mar. 12, 2012

(65) Prior Publication Data

US 2012/0223106 A1 Sep. 6, 2012

Related U.S. Application Data

(63) Continuation of application No. PCT/FR2010/051877, filed on Sep. 9, 2010.

(30) Foreign Application Priority Data

Sep. 11, 2009 (FR) ..... 09 56278

(51) Int. Cl.
*B65D 5/72* (2006.01)
*B65D 47/20* (2006.01)
*B05B 11/00* (2006.01)

(52) U.S. Cl.
CPC ..... *B65D 47/2031* (2013.01); *B65D 47/2081* (2013.01); *B05B 11/0021* (2013.01)
USPC ..... 222/494; 222/1; 222/189.06; 222/547; 222/496; 222/422; 222/212

(58) Field of Classification Search
USPC ..... 222/212–215, 420–422, 494, 495–497, 222/511, 110, 589, 402.22, 1, 189.06, 477, 222/547
See application file for complete search history.

(56) References Cited

U.S. PATENT DOCUMENTS 3,441,179 A * 4/1969 Ragan ..... 222/129
5,025,957 A * 6/1991 Ranalletta et al. ..... 222/189.09
5,154,325 A * 10/1992 Ryder et al. ..... 222/189.06
5,240,149 A 8/1993 Schmidt
5,320,254 A * 6/1994 Ranalletta et al. ..... 222/189.08
5,431,310 A * 7/1995 Kanner et al. ..... 222/212
5,692,651 A 12/1997 Fuchs (Continued)

FOREIGN PATENT DOCUMENTS

EP 1266840 A2 12/2002
EP 1614636 A1 1/2006

(Continued)

OTHER PUBLICATIONS

International Search Report; Application No. PCT/FR2010/051877; Issued: Nov. 18, 2010; Mailing Date: Dec. 1, 2010; 3 pages.

(Continued)

*Primary Examiner* — Frederick C Nicolas
*Assistant Examiner* — Bob Zadeh
(74) *Attorney, Agent, or Firm* — St. Onge Steward Johnston & Reens LLC

(57) ABSTRACT

A liquid dispenser device including a valve with a valve member-forming portion for blocking and passing liquid out from the device, and a fastener edge for permanently fastening the valve relative to a container, the fastener edge including a tubular fastener wall sandwiched between an inner tubular wall and an outer tubular wall.

9 Claims, 1 Drawing Sheet

(56) References Cited

U.S. PATENT DOCUMENTS

| | | | | |
|---|---|---|---|---|
| 6,896,151 | B1 * | 5/2005 | Robinson | 222/1 |
| 7,303,098 | B2 * | 12/2007 | Backes | 222/212 |
| 7,516,874 | B2 * | 4/2009 | Kneer | 222/497 |
| 8,322,578 | B2 * | 12/2012 | Janssen et al. | 222/493 |
| 2002/0190079 | A1 * | 12/2002 | Hamamoto | 222/105 |

FOREIGN PATENT DOCUMENTS

| | | | |
|---|---|---|---|
| FR | 2377338 | A1 | 8/1978 |
| FR | 2846945 | A1 | 5/2004 |
| JP | 2000226050 | A | 8/2000 |
| WO | 0029296 | A1 | 5/2000 |
| WO | 03089325 | A2 | 10/2003 |

OTHER PUBLICATIONS

Japanese Notice of Reasons for Rejection and Translation thereof Application No. 2012-528426 Mailing Date: Feb. 4, 2014 8 pages.

* cited by examiner

LIQUID DISPENSING DEVICE

CROSS-REFERENCE TO RELATED APPLICATIONS

The present application is a continuation of pending International patent application PCT/FR2010/051877 filed on Sep. 9, 2010 which designates the United States and claims priority from French patent application 0956278 filed on Sep. 11, 2009, the content of which is incorporated herein by reference.

FIELD OF THE INVENTION

The invention relates to the field of dispensing liquid in the form of drops, in particular in the field of pharmaceuticals, e.g. a liquid for eyedrops or eardrops.

BACKGROUND OF THE INVENTION

Document U.S. Pat. No. 5,154,325 discloses a liquid dispenser device including an elastomer diaphragm forming a valve member that is disposed between a support and a housing that are mounted on the container. The diaphragm includes a peripheral annular bead and it is held on the device by pinching the bead between the top surface of the support and the bottom surface of the housing. The diaphragm is thus held in the device by being pinched along the axial direction of the device.

A drawback of that type of assembly lies in the fact that when the user squeezes the container in order to expel liquid, the liquid exerts pressure on the diaphragm in the axial direction in order to open it, and such pressure may give rise to liquid leaking at the periphery of the diaphragm. This risk of leaks is made that much more probable when the parts present dimensions or relative positions that might vary as a result of manufacturing tolerances. Unfortunately, the presence of a leak from the device is troublesome, particularly if the liquid does not include any preservative, since the liquid is then to be found at non-desirable locations in the device and that encourages bacteria to develop, which can consequently contaminate the liquid.

SUMMARY OF THE INVENTION

A particular object of the present invention is to provide a dispenser device in which sterility is improved.

To this end, the invention provides in particular a liquid dispenser device including a valve comprising:

- a valvemember-forming portion for blocking and passing liquid out from the device; and
- a fastener edge for permanently fastening the valve relative to a container, the fastener edge comprising a tubular fastener wall sandwiched between an inner tubular wall and an outer tubular wall.

It can be understood that the inner and outer tubular walls are arranged in such a manner that they apply radial compression to the fastener wall of the valve, i.e. they press against both sides of the fastener wall in the radial direction, corresponding to the direction that is perpendicular to the axis of the tubular walls, this radial compression serving to seal the valve.

In other words, in the valve fastener zone, the dispenser device has three concentric tubes, possibly short in length, the inner tube corresponding to the inner tubular wall, the intermediate tube corresponding to the fastener wall of the valve, and the outer tube corresponding to the outer tubular wall.

These tubes all have the same axis corresponding to the axis of the dispenser device, this axis generally being an axis of revolution of the device, in particular of the container, corresponding to the direction in which liquid leaves the valve member. It can be understood that in order to provide satisfactory sealing, the diameter of the inner tubular wall is slightly greater than the diameter of the fastener wall that in turn is slightly greater than the diameter of the outer tubular wall.

By fastening the valve in this way by radial pinching, sealing is obtained by clamping in a direction that is other than the liquid-ejection direction. Thus, when liquid leaves the device and exerts pressure on the valve in order to enable it to take up its liquid-passing configuration, the pressure exerted by the liquid in the axial direction is not exerted in the direction that serves to fasten the valve. In other words, on leaving, the liquid exerts axial pressure on the valve giving rise to relatively low stress in the radial direction of the valve. Furthermore, the risk of any movement of the fastener elements of the valve, such as the inner and outer tubular walls, is relatively low. In any event, it is less than when the valve is fastened by clamping in the axial direction, which corresponds generally to the direction in which the fastener elements are assembled together, and which tends to cause the fastener elements to move and thus to give rise to leaks. It can be understood that the proposed configuration generates less stress on the fastener elements and thus provides better sealing, so the device is more sterile and operates well.

The proposed device requires less accuracy for the dimensions of the fastener elements. Pinching via tubes guarantees good sealing even if the relative positions of the components vary a little in the axial direction as a result of manufacturing tolerances or of positioning tolerances during assembly in the axial direction.

Furthermore, since the dispenser device is often assembled in the axial direction, the outer or inner tubular wall may advantageously constitute a wall for centering the valve, thereby facilitating assembly thereof.

Finally, it should be observed that using tubular walls is advantageous in terms of compactness. The axial position of the fastener zone may be more situated in the downstream direction of the dispenser device, e.g. on either side of the valvemember-forming portion, thus making it possible to reduce the diameter of the dispenser endpiece. Furthermore, the fact that sealing is exerted by tubular walls serves to increase the area of the compression exerted by the fastener elements, thereby providing better sealing.

It should be observed that the proposed device is very useful when it is desired to dispense a liquid that does not include any preservative. With a liquid of this type, it is necessary to ensure that sealing is particularly reliable.

The device may also include one or more of the following characteristics.

The outer tubular wall is carried by a support mounted on the container.

The support includes a valve seat that is substantially in the form of a disk, being delimited by the outer tubular wall. This outer tubular wall preferably projects from the distal face of the disk (from its face that is closer to the liquid dispenser end). Thus, the support presents the general shape of a circular tray with its tubular portion constituting an edge of height that is sufficient to be sandwiched between the inner and outer tubular walls.

The valve seat further includes a cylindrical central portion having its distal end forming a bearing surface for the valvemember-forming portion of the valve when in the liquid-blocking configuration. Also preferably, this central portion projects from the distal face of the disk.

The valve includes a screen delimited at its periphery by the fastener wall.

The valve also includes a cylindrical central portion that projects from the screen and that has its distal end constituting the valvemember-forming portion of the valve. Thus, the valve has a shape that is complementary to a support portion.

The inner tubular wall is carried by a housing that is mounted on the container, covering the valve at least in part. The housing preferably includes a central orifice through which the distal end of the valve passes.

The housing includes a groove defined by the inner tubular wall, a bottom wall, and an outer shell, this groove sandwiching the fastener wall of the valve together with the outer tubular wall.

The device includes snap-fastener means for snap-fastening the housing on the support. The snap-fastening is preferably performed in the axial direction, i.e. the parts are moved towards each other in the axial direction in order to snap-fasten them together.

The snap-fastener means for snap-fastening are configured in such a manner that snap-fastening also corresponds to permanently fastening the valve by pinching between the inner tubular wall and the outer tubular wall.

The valvemember-forming portion of the valve and the fastener edge of the valve are made of elastomer material.

The valve includes a rigid portion, preferably acting as a bearing surface for a spring.

The invention also provides a method of assembling the device, the method comprising the following successive steps:

installing the valve on a support by inserting the fastener wall of the valve inside the outer tubular wall;

installing a housing over the valve by inserting the inner tubular wall inside the fastener wall of the valve; and snap-fastening the housing on the support.

Optionally, between the step of installing the valve on the support and the step of installing the housing over the valve, provision may be made to insert a spring, the spring being inserted around the central cylindrical portion of the valve.

BRIEF DESCRIPTION OF THE DRAWINGS

The invention can be better understood on reading the following description given purely by way of example and made with reference to the drawing, in which.

DETAILED DESCRIPTION OF THE INVENTION

Figure 1:
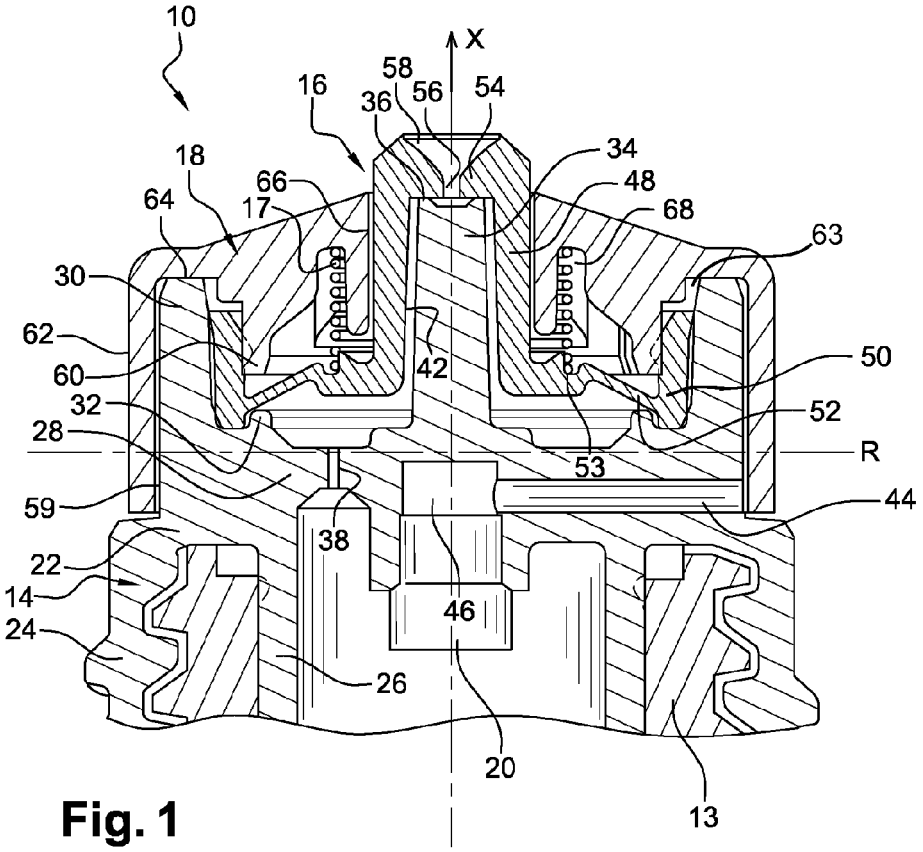
FIG. 1 is a section view of a dispenser device in an embodiment.

FIG. 1 shows a device 10 for dispensing liquid in the form of drops. In this example, the dispensed liquid is a pharmaceutical liquid, such as a liquid for forming eyedrops or eardrops. The device 10 comprises a dispenser endpiece 12 screw-fastened on the neck of a container 13. The device 10 is configured so as to dispense liquid as a result of the user squeezing the container 13. In this example, the container is elastically deformable so as to return to its previous shape after being squeezed by a user. The device 10, or at least the container 13, has an axis X of revolution corresponding generally to the liquid ejection direction.

The endpiece 12 comprises a support 14, a valve 16, a spring 17, a housing 18, and a hydrophobic filter 20.

In this example, the support 14 comprises a fastener portion 22 disposed at the proximal end of the endpiece for fastening the support on the container 13. This portion 22 comprises an outer skirt 24 tapped so as to be screw-fastened on the neck of the container 13, and an inner skirt 26 of tubular shape serving to provide sealing between the container 13 and the dispenser endpiece 12.

The support 14 also includes an intermediate portion 28 forming a seat for the valve 16. This intermediate portion 28 is substantially in the form of a disk extending in a radial plane R perpendicular to the axis X. On its distal face, the disk 28 is delimited by a tubular outer wall 30. This wall forms a peripheral skirt of the disk 28, and it extends perpendicularly to the disk 28 in the form of a tube of axis X that is sufficiently tall to receive the valve 16, as described below. Near the bottom end of the tubular wall 30, the disk 28 includes an annular rib 32 serving to define a groove for centering and receiving the edge of the valve 16. The disk 28 also has a cylindrical central portion 34 for closing the valve, which portion projects from its center from the distal side of the disk 28 and carries at its distal end a bearing surface 36 of the valve 16. This portion 34 forms a shutter peg enabling the valve 16 to open or close. The disk 28 is also pierced by a channel 38 for passing liquid coming from the container. The channel 38 opens out to a cavity 40 delimited in particular by a recess formed in the distal surface of the disk 28. This cavity 40 also opens out to a second channel 42 for passing liquid, defined between the peg 34 and the valve 16. The channels 38 and 42 are of axes substantially parallel to the axis X. As can be seen in FIG. 1, the disk 28, the outer tubular wall 30, and the shutter peg 34 together define a tubular cavity for receiving the valve 16.

Furthermore, the support 14 has a channel 44 for passing air into the container, the channel 44 opening out into a housing 46 for receiving the hydrophobic filter 20, the housing 46 being cylindrical and open at its proximal end into which the filter 20 is inserted.

The valve 16 has a central cylindrical portion 48, an annular peripheral skirt 50, the central portion 48 and the skirt 50 being connected together by a screen 52 of material. On its distal surface, the screen 52 carries a bearing surface 53 for the spring 17. The distal portion 54 of the central portion 48 is a portion forming a valve member for blocking or passing liquid by co-operating with the bearing surface 36. Thus, the surface 36 forms a bearing surface for the valvemember-forming portion 54 when said portion is in its liquid-blocking configuration. The top surface of the portion 48 includes a liquid ejection channel 56 that opens out into a drop-metering shape 58.

The skirt 50 forms a fastener edge for fastening the valve 16 on the support, for fastening the valve permanently relative to the container 13. It is constituted by a tubular fastener wall 50 of axis X and of diameter that is slightly greater than the inside diameter of the outer tubular wall 30.

In this example, the valve 16 is made entirely out of an elastomer material. Nevertheless, it is possible for the valve to include certain portions that are made of an elastomer material and others out of a material that is more rigid, in particular the portion 53 forming a bearing surface for the spring 17. The valvemember-forming portion 54, the screen 52, and the fastener wall 50 are preferably made of elastomer material.

The housing 18 is mounted onto the support 16 by snap-fastener means 59. The snap-fastener means 59 enable the housing 18 to be snap-fastened relative to the support 14 when they are assembled together along the axial direction X. It carries an inner tubular wall 60 about the axis X and of diameter that is slightly greater than the diameter of the valve fastener wall 50. The housing 18 also includes an outer shell 62 forming an outer skirt that extends in the proximal direction relative to the remainder of the housing 18, and also a bottom wall 64 configured in such a manner that the wall 60, the bottom wall 64 and the shell 62 define a groove 63 for sandwiching the fastener wall 50 and the outer tubular wall 30. The housing 18 covers a major fraction of the valve 16, but it is nevertheless pierced in its center by the central portion 48 of the valve. For this purpose, the housing 18 defines a cylindrical cavity by means of a tubular inner skirt 66 having the function of centering the valve 16. The skirt 66 also defines a groove 68 forming a bearing seat for the spring 17.

The operation of the device 10 is described below.

When a user squeezes the container 13, the fluid is subjected to pressure and since it cannot pass via the hydrophobic filter 20 it flows into the channel 38 and then into the cavity 40 and the channel 42.

The pressure of the fluid in the channel 42 deforms the valvemember-forming portion 54 so as to cause it to move from its liquid-blocking configuration to a liquid-passing configuration by the portion 54 lifting off the bearing surface 36. This deformation is made easier by the spring 17 being compressed under the pressure of the liquid. The liquid is thus dispensed in the form of drops.

Assembly of the device is described below with reference to FIGS. 2*a* to 2*d*.

Assembly comprises a step of assembling the endpiece 12, then followed by a step of screwing the endpiece 12 onto the container 13.

Figures 2A, 2B, 2C, 2D:
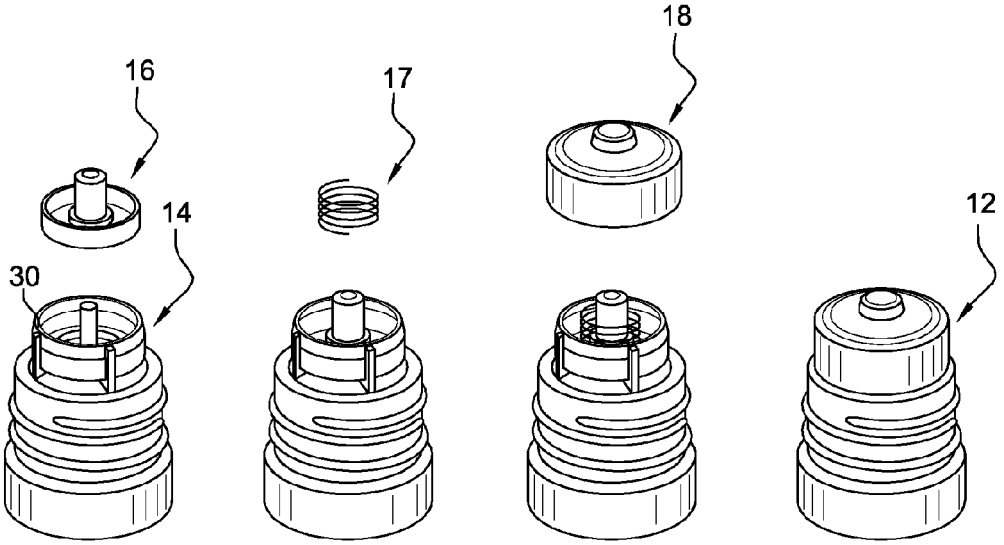
FIGS. 2*a* to 2*d* are perspective views showing the method of assembling the FIG. 1 device.

Assembly of the endpiece 12 begins by a step of installing the valve 16 on the support 14 by inserting the fastener wall 50 of the valve inside the tubular wall 30 of the support 14. This step is shown in FIG. 2*a* and it is followed by a step of inserting the spring 17 around the central portion 48 of the valve, shown in FIG. 2*b*. Once the spring is in place, there follows a step of installing the housing 18 on the valve 16, as shown in FIG. 2*c* by inserting the inner tubular wall 60 inside the fastener wall 50. This installation of the housing 18 is terminated by snap-fastening the housing on the support 14, shown in FIG. 2*d*, this snap-fastening taking place simultaneously with the valve 16 being fastened permanently on the endpiece 12, being sandwiched between the inner and outer tubular walls 60 and 30. It should be observed that when the valve 16 is fastened on the device, the screen 2 is subjected to elastic stress so as to press the end 54 against the surface 36. This is also made easier by the return force from the spring.

Among the advantages of the device, it can be understood that the static sealing provided around the fastener wall 50 by pinching of the walls 60 and 30 is particularly effective. When liquid escapes from the container 13 it exerts pressure on the valve 16 in the direction X, and this pressure in the direction X is not transferred to the fastener portion 50, since fastening of the valve is provided by compression in the radial direction R.

It should be observed that the invention is not limited to the above-described embodiments.

What is claimed is:

1. A liquid dispenser device including a valve, comprising:

a valvemember-forming portion for blocking and passing liquid out from the device; and a fastener edge for permanently fastening the valve relative to a container, the fastener edge comprising a tubular fastener wall sandwiched radially between an inner tubular wall and an outer tubular wall, the inner tubular wall being carried by a housing mounted on the container, and the housing covering the valve, at least in part;

wherein the device has an axis of revolution defining an axial direction, and the inner tubular wall, the tubular fastener wall, and the outer tubular wall are three concentric tubes about the axis of revolution;

wherein the outer tubular wall is carried by a support mounted on the container and the inner and outer tubular walls apply radial compression to the tubular fastener wall, the radial compression applied radially with respect to the device; and wherein the housing includes a groove defined by the inner tubular wall, a bottom wall and an outer shell the groove sandwiching the fastener wall of the valve together with the outer tubular wall.

2. The device according to claim 1, wherein the valve seat further includes a cylindrical central portion a distal end forming a bearing surface for the valvemember-forming portion of the valve when in the liquid-blocking configuration.

3. The device according to claim 1, wherein the valve includes a screen delimited having a periphery by the fastener wall and including a central cylindrical portion projecting from the screen and having an end constituting the portion forming the valve member of the valve.

4. The device according to claim 1, including snap-fastener means for snap-fastening a housing carrying the inner tubular wall and a support carrying the outer tubular wall, snap-fastening taking place in the axial direction.

5. The device according to claim 1, wherein the snap-fastener means are configured in such a manner that snap-fastening also corresponds to permanently fastening the valve by pinching between the inner tubular wall and the outer tubular wall.

6. The device according to claim 1, wherein the valvemember-forming portion of the valve and the fastener edge of the valve are made of elastomer material.

7. The device according to claim 6, wherein the valve includes a rigid portion.

8. The device according to claim 1, wherein the support includes a valve seat having substantially the shape of a disk that is delimited by the outer tubular wall.

9. A method of assembling a liquid dispenser device including a valve having a valvemember-forming portion for blocking and passing liquid out from the device and a fastener edge for permanently fastening the valve relative to a container, the fastener edge including a tubular fastener wall, the method comprising the steps of:

installing the valve on a support mountable on the container by inserting the tubular fastener wall radially inside an outer tubular wall of the support;

installing a housing over the valve by inserting an inner tubular wall of the housing radially inside the tubular fastener wall of the valve, wherein the device has an axis of revolution defining an axial direction, and the inner tubular wall, the tubular fastener wall, and the outer tubular wall are three concentric tubes about the axis of revolution; and snap-fastening the housing on the support such that the tubular fastener wall is sandwiched radially between the inner tubular wall and the outer tubular wall and the inner and outer tubular walls apply radial compression to the tubular fastener wall, the radial compression applied radially with respect to the device;

wherein the housing includes a groove defined by the inner tubular wall, a bottom wall, and an outer shell, the groove sandwiching the tubular fastener wall of the valve together with the outer tubular wall.

* * * * *